US005365714A

United States Patent [19]

Potvin

[11] Patent Number: 5,365,714

[45] Date of Patent: Nov. 22, 1994

[54] SAWDUST BUILDING BLOCKS ASSEMBLY

[76] Inventor: Ricardo Potvin, 854 - 5th Street, Chibougamau, Québec, Canada, G8P 1V4

[21] Appl. No.: 941,200

[22] Filed: Sep. 4, 1992

[51] Int. Cl.[5] ..... E04B 2/08

[52] U.S. Cl. ..... 52/590.2; 52/590.1; 52/596; 52/603; 52/605

[58] Field of Search ..... 52/569, 596, 605, 607, 52/593, 603, 606, 590, 590.1, 590.2, 590.3

[56] References Cited

U.S. PATENT DOCUMENTS

| | | | |
|---|---|---|---|
| 314,022 | 3/1885 | Heard | 52/605 |
| 786,884 | 4/1905 | Faulkner | 52/289 |
| 800,385 | 9/1905 | Miller | 52/289 |
| 1,959,816 | 5/1934 | Crum | 52/606 |
| 1,984,393 | 12/1934 | Brown | 52/593 |
| 3,305,982 | 2/1967 | Steele | 52/593 |
| 4,060,952 | 12/1977 | Hernandez | 52/593 |
| 4,213,928 | 7/1980 | Casselbrant | 264/113 |
| 4,436,447 | 3/1984 | Crowe | 52/590 X |
| 5,074,091 | 12/1991 | Brouard | 52/439 |

FOREIGN PATENT DOCUMENTS

| | | | |
|---|---|---|---|
| 2169932 | 7/1986 | United Kingdom | 52/605 |

*Primary Examiner*—Carl D. Friedman
*Assistant Examiner*—Kevin D. Wilkens
*Attorney, Agent, or Firm*—Pierre Lespérance; Francois Martineau

[57] ABSTRACT

A wall for a rampart or building, consisting of a plurality of building blocks, each comprising slightly compacted sawdust or wood chips glued with resin. The building blocks are interconnected by a number of assembling pins and by recesses integral to the respective blocks, so as to frictionally engage into one another. There are also provided full length projections and corresponding grooves of the respective blocks for the same purposes. The thus erected structure is remarkable by the quality of the joints and by the ease and quickness of its assembly or disassembly.

1 Claim, 4 Drawing Sheets

52a
A
A
.5773A
32

32
24

32
28

32
24
28

22
52b
30

24
30

30
28

24
30
28

24
54a
A 24
22
.5773A
28
A
A/2
3A 24
30
54b 24
22
30
28

32

56a
A

.5773A
32
28
A
A/2
2A
58
28
A
A/2
A
2A 56b
30

30
28

28
A/2
A

SAWDUST BUILDING BLOCKS ASSEMBLY

FIELD OF THE INVENTION

The present invention relates to construction materials for self-standing walls of buildings, ramparts, fences, and the like.

OBJECTS OF THE INVENTION

An important object of the invention is to provide a system of modular dismantleable units for the erection of a self-standing wall, which will enable the easy and quick dismantling thereof.

Another important object of the invention is that this system of dismantleable modular units comprise connectors that interconnect the modular units in a thermally insulating fashion.

Another object of the invention is that said connectors of this system of dismantleable modular units make all the wall waterproof.

Still another object of the invention is that said connectors of this system of dismantleable modular units ensure airtightness so that the wall be further efficiently used as a windbreaker.

SUMMARY OF THE INVENTION

Accordingly with the objects of the invention, there is disclosed the combination of at least three building blocks, each consisting of slightly compacted sawdust or wood chips glued by a glue compound, two of said blocks comprising first relative interlocking means of the male-female coupling type, to secure said two blocks in overlying fashion, and a third of said blocks as well as one of said two blocks comprising second relative interlocking means of the male female coupling type, for securing these two latter blocks in side by side fashion; wherein the thus formed Joints are of high quality and the dismantling of the wall is easily and quickly done; and wherein said first relative interlocking means consists of a plate, integral to the upper face of a first block, and of a cylindrical assembling pin integral to the free face of said plate, and of a recess on the lower face of a second block which recess is the mirror image of said plate and of the assembling pin whereby the latter are frictionally engageable into the recess.

Preferably, said cylindrical assembling pin has a slightly conical shape. Profitably, said second relative interlocking means consists of a groove of quadrangular cross-section, made full length on the side face of a first block, and a cross-sectionally quadrangular projection made full length on the side face of a second block, whereby it can frictionally engage said groove.

Alternately, the invention consists also of the combination of at least three building blocks, each consisting of slightly compacted sawdust or wood chips glued by a glue compound, two of said blocks comprising first relative interlocking means of the male-female coupling type, for securing said two blocks in superimposed fashion, and the third of said blocks as well as one of said two blocks comprising second relative interlocking means of the male female coupling means, for securing these two latter blocks in side by side fashion; wherein the thus formed Joints are of high quality and can be easily and quickly disassembled; and wherein said first relative interlocking means consists of a cross-shaped groove being quadrangular in cross-section, and made on the upper face of a first block, and of a cross-shape projection being quadrangular in cross-section, made on the lower face of a second block so as to be able to frictionally engage said groove.

DETAILED DESCRIPTION OF THE INVENTION

Figure 7:
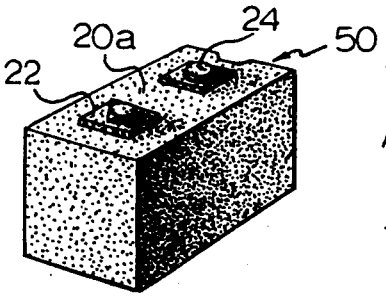
FIG. 7 is a perspective view of a building block of the invention.
Figure 7A:
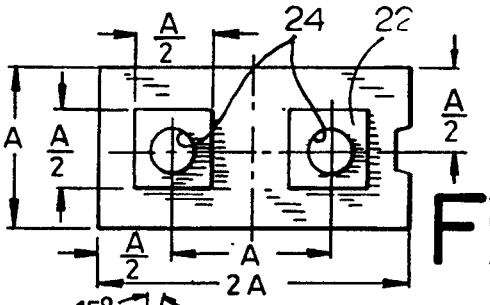
FIG. 7*a* is a top plan view of the block of FIG. 7.
Figures 9, 9A, 9B, 9C, 9D, 9E, 9F, 9G, 10, 10A, 10B, 10C, 11, 11A, 11B, 11C, 12, 13:
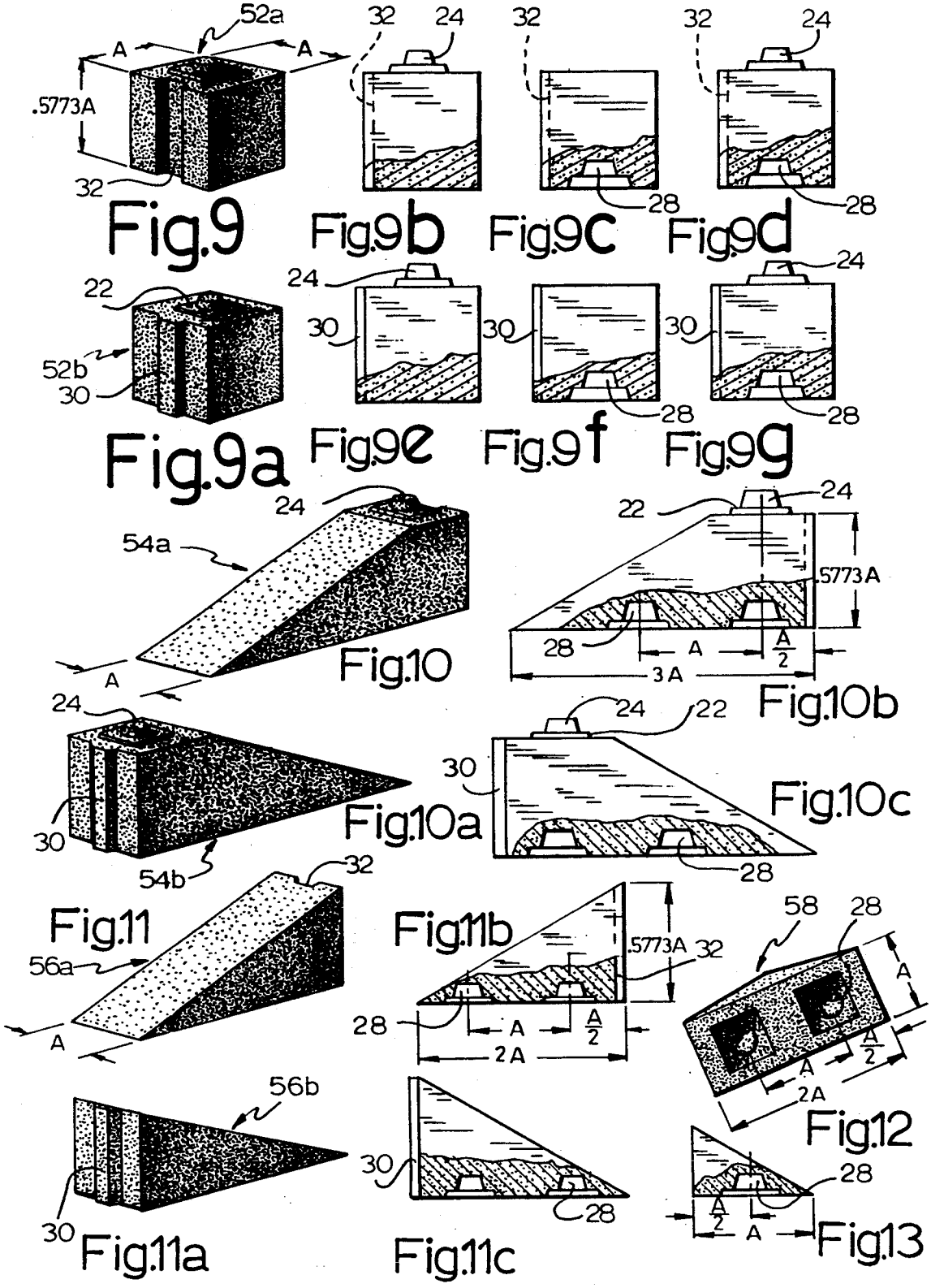
FIGS. 9 and 9*a* are perspective views of two other preferred embodiments of building blocks according to the invention.
FIGS. 9*b*, 9*c* and 9*d* are partly sectional elevational views of various embodiments of blocks according to the invention.
FIGS. 9*e*, 9*f* and 9*g* are partly sectional elevational views of various embodiments of blocks of the invention.
FIGS. 10 and 10*a* are perspective views of other embodiments of building blocks according to the invention.
FIGS. 10*b* and 10*c* are partly sectional, side elevational views of construction blocks of FIGS. 10-10*a* respectively.
FIGS. 11 and 11*a* are perspective views of other building blocks of the invention.
FIGS. 11*b* and 11*c* are partly sectional, side elevations of the building blocks of FIGS. 11 and 11*a* respectively.
FIG. 12 is a perspective view of another building block of the invention.
FIG. 13 is a partly sectional, side elevation of a building block of the invention.
Figure 14:
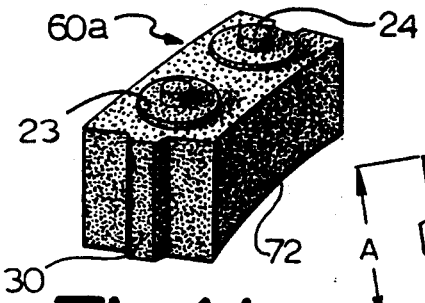
FIGS. 14, 15, 16, 16*b* and 17–17*a* are perspective views of other embodiments of building blocks according to the invention.
Figure 14A:
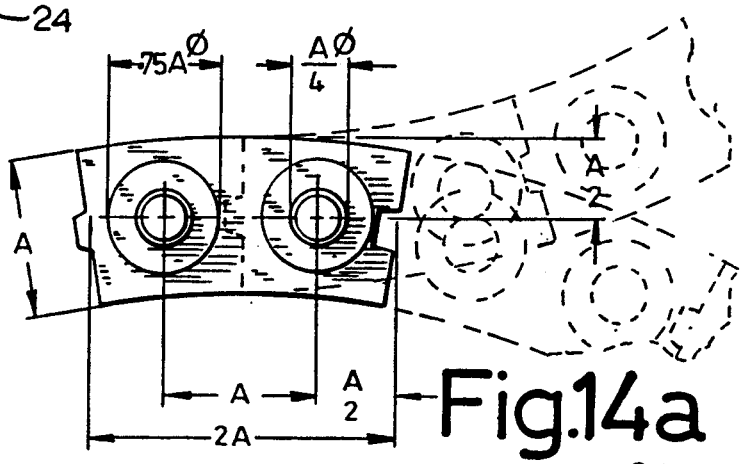
FIG. 14*a* is a top plan view of the building block of FIG. 14, showing in phantom lines the outline of other blocks forming a portion of rampart.
Figure 15:
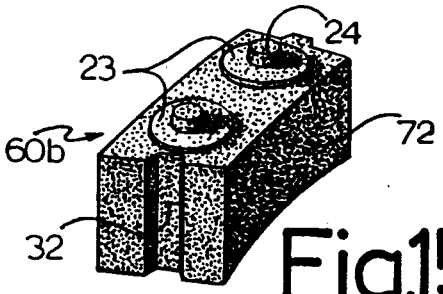
Figure 14B:
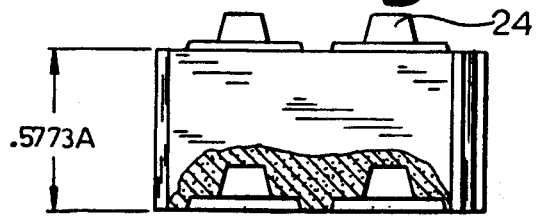
FIG. 14*b* is a partly sectional, side elevation of the block of FIG. 14.
Figure 16:
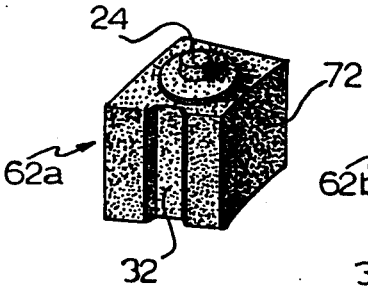
Figure 16B:
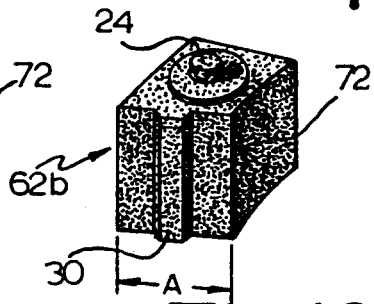
Figure 16A:
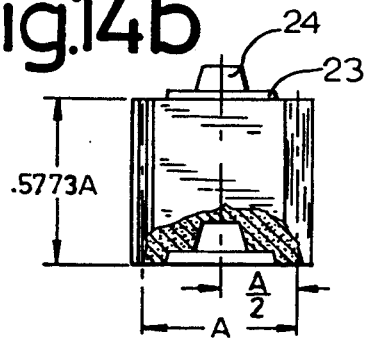
FIG. 16*a* is a partly sectional, side elevational view of the block illustrated in FIG. 16*b*.
Figure 17:
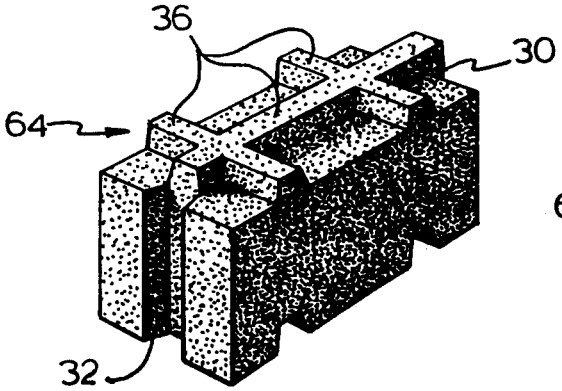
Figure 17A:
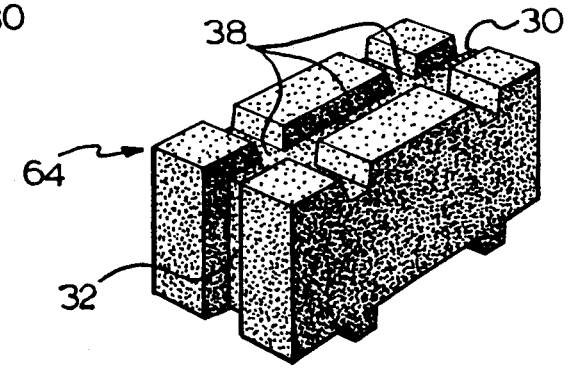

There is provided building blocks of various shapes, namely and in cross-section:

(a) rectangular, 50, see FIG. 7;

(b) square, 52*a*, 52*b*, see FIGS. 9 and 9*a*;

(c) substantially triangular, 54*a*, 54*b* (with square extensions), 56*a* and 56*b*, 58, see FIGS. 10, 10*a* 11, 11*a*, 12;

(d) rectangular with a concave edge, 60*a*, 60*b*, see FIGS. 14 and 15;

(e) a square with a concave edge 62*a*, 62*b*, see FIGS. 16 and 16*b*; and (e) rectangular with cross-shaped faces 64, see FIGS. 17 and 17*a*.

Each building block consists of slightly compacted Sawdust or wood chips glued with resin, so as to produce an integral coherent body. Such a building block 50, etc., will be of light weight but, since during the compacting process, air will have become trapped between the wood particles, a thermal barrier will form at the same time, as well as an efficient windbreaker and a water-tight rampart.

Figure 8:
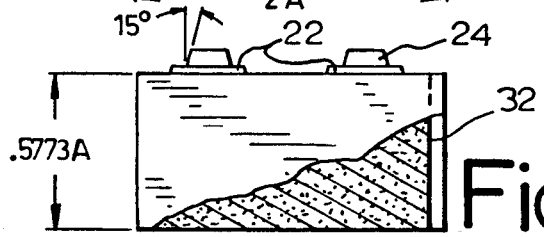
FIGS. 8, 8*a* and 8*b* show partly sectional, front elevational views of three preferred embodiments of building blocks of the invention.
Figure 8A:
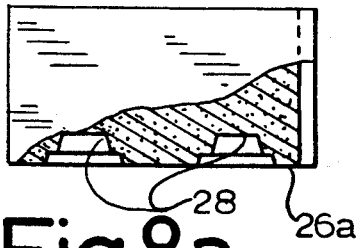
Figure 8B:
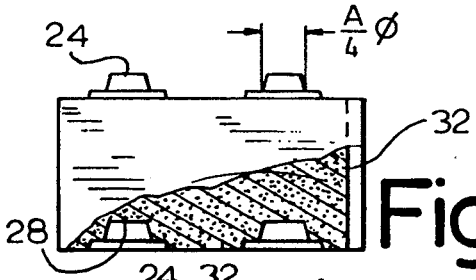
Figure 8C:
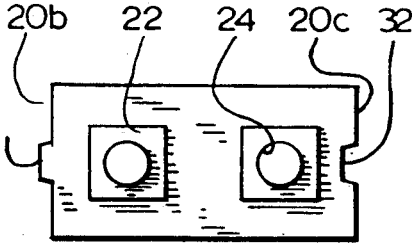
FIGS. 8*c* to 8*h* are top plan views of various preferred embodiments of building blocks according to the invention.
Figure 8D:
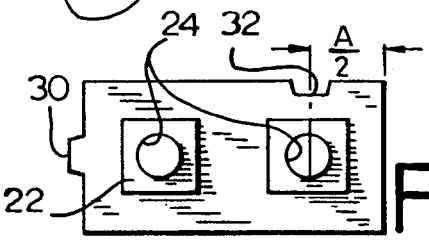
Figure 8E:
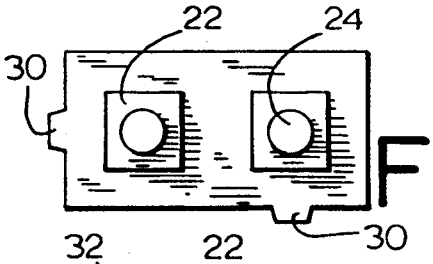
Figure 8F:
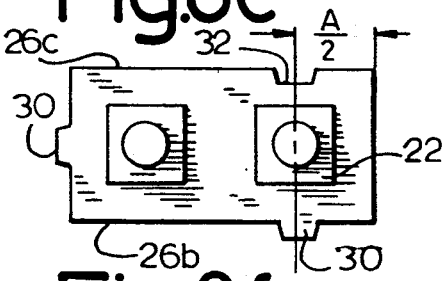
Figure 8H:
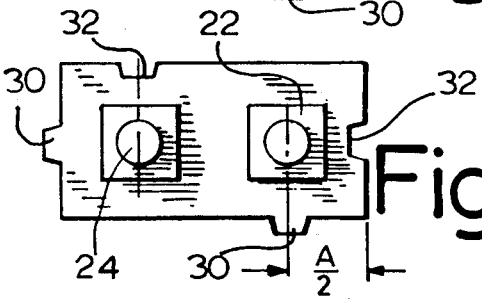
Figure 8G:
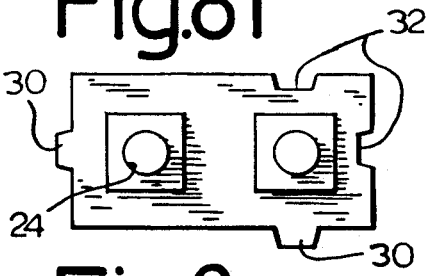

On FIG. 7, there is shown that, on the face 20*a* of the building block 50, two quadrangular plates 22 (although discoid plates 23—FIGS. 14 et seq—are also envisioned), integral to the block and from each of which projects a short cylindrical assembling pin 24. The assembling pins 24 are integral to the plates 22 or 23 and may boast a slight conicity, as suggested in FIGS. 8 and 8*b*. In the same fashion, other building blocks 50 comprise on one face 26*a* two recesses 28 (FIGS. 8*a* and 8*b*) defining a shape being a mirror image of the plates 22 or 23 and of the assembling pin 24. One assembling pin 24 and its plate 22 or 23 from a first block 50 are destined to frictionally engage a recess 28 from another block 50, when these two building blocks become superimposed or set side by side, so as to ensure a high quality (thorough) joint.

Indeed, because of the texture of the sawdust or of the wood chips, their frangible nature enables a wide margin of physical expansion or retraction during thermal gradients of ambiant environment, and the joint 22 or 23, 24 and 28 will maintain all its thoroughness. The same advantages can be found with respect to the features of the windbreaker, and to the means for countering moisture and rainwater through seeping.

The quality of the joints between the building blocks constitutes an essential part of the present invention. Another essential feature of the building blocks according to the invention is to provide a great ease in installation and dismantling by male-female couplings of said building blocks, and this constitutes a consequence of the Joints of these blocks. Indeed, a variety of shapes can therefore be envisioned for such constructions to be erected, such as for upright walls 66 or circular walls 68 for buildings, or curved walls for constituting ramparts or windbreakers 70.

In view of improving the cohesion of the blocks 50 interlocked to one another, while not hindering the great ease of dismantling of the thus erected structure, one may add to a second face 20*a* or 26*b* an intermediate projection 30 being cross-sectionally rectangular, and to a third face 20*c* or 26c an intermediate recess 32 being a mirror image of the projection 30. The full length projection 30 of one block 20 is destined to engage a corresponding recess 32 from another block 26, when the two blocks 20, 26 are transversely interlocked.

Other construction blocks may also further include a recess 32 and a projection 30 on two first faces, corresponding projections and recesses of more complex shapes on the two other faces, such as the double cross of projections 36 and recesses 38 from the building block of FIGS. 17 and 17*a*. Hence, the shape of the male-female structures for the Joints may vary, however, these structures should always comprise smooth, external surfaces, never irregular, so as to facilitate the mechanical play required for the expansion and retraction of the materials which follow thermal gradients that may be sustained by the building block assembly.

Figure 1:
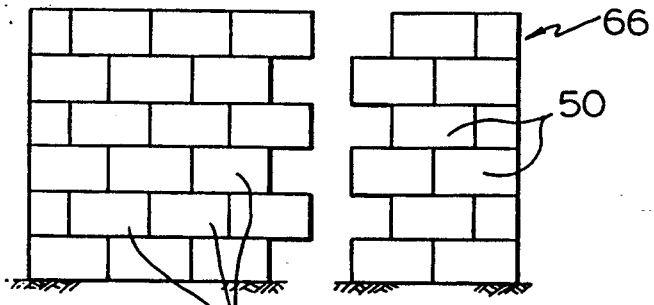
FIGS. 1 to 3 show partial, front elevational views of erected walls consisting of a plurality of building blocks in accordance with the invention.
Figure 3:
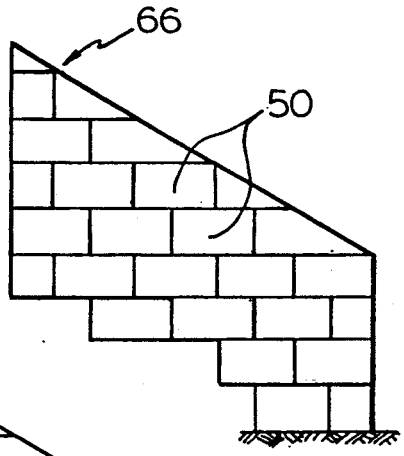
Figure 2:
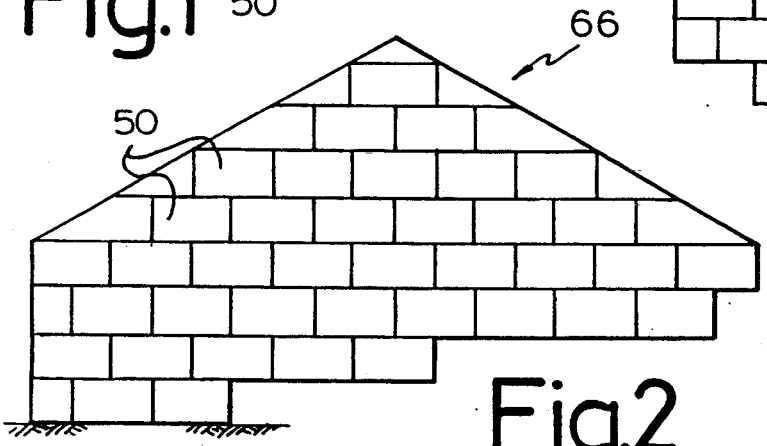
Figure 4:
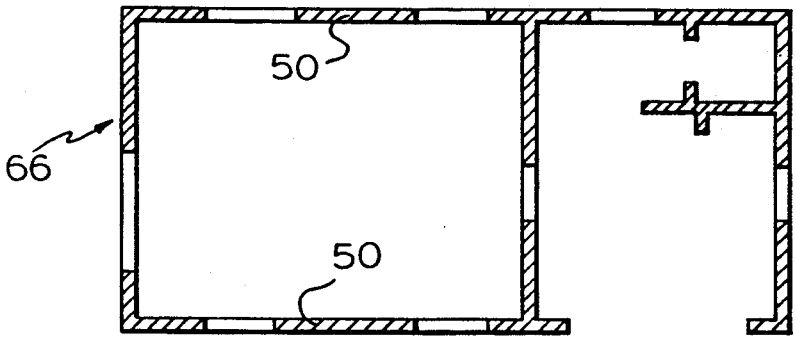
FIGS. 4–5 are horizontal sectional views of buildings made up of erected walls consisting of the building blocks of the invention.
Figure 5:
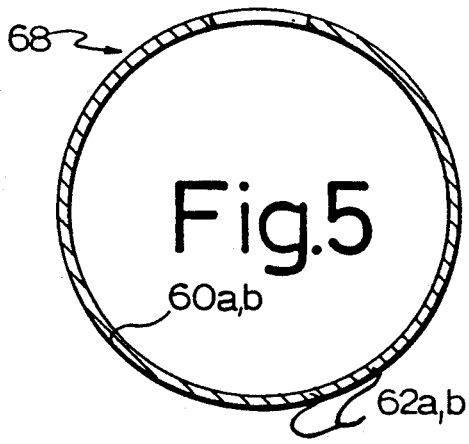
Figure 6:
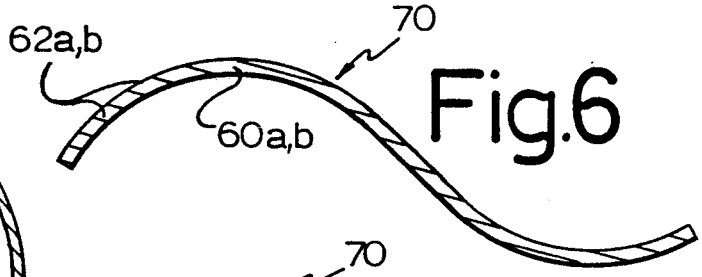
FIGS. 6 and 6*a* are horizontal sectional views of curved ramparts consisting of the building blocks of the invention.
Figure 6A:
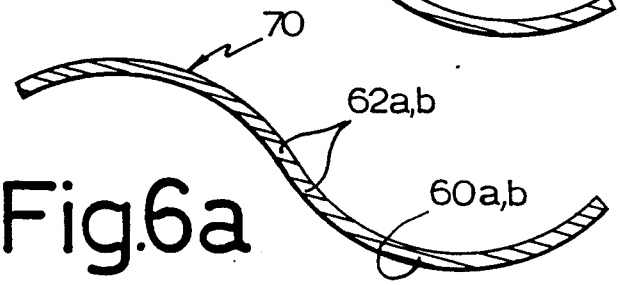

The concave faces 72 of the building blocks 60*a*, 60*b*, 62*a*, 62*b* enable the use of these blocks in the assembly of curved structures 68 and 70 (FIGS. 5 and 6).

I claim:

1. The combination of at least three building blocks, each block consisting of slightly compacted sawdust or wood chips glued by a glue compound and lacking any void or hollow sections, two of said blocks comprising first relative interlocking means of the male female coupling type, for securing said two blocks one on top of the other, thus forming a first joint and defining a first and a second superposed blocks, each of said superposed blocks defining an upper face and a lower face, said upper face of said first superposed block releasably abutting on said lower face of said second superposed block; and the third of said blocks as well as one of said two superposed blocks comprising second relative interlocking means of the male-female coupling type, for securing these two latter blocks in side by side fashion, thus forming a second joint and defining a first and a second side by side blocks, each of said side by side blocks defining a first and a second opposite lateral side faces, said first side face of said first side by side block releasably abutting against said second side face of said second side by side block; wherein said first and second joints are of high quality and can be easily and quickly disassembled; and wherein said first relative interlocking means consists of a cross-shaped groove being quadrangular in cross-section, and made on said upper face of said first superposed block, and of a cross-shape projection being quadrangular in cross-section, made on said lower face of said second superposed block so as to be frictionally releasably engaged into said groove.

* * * * *